US012220612B2

(12) United States Patent
Yu et al.

(10) Patent No.: US 12,220,612 B2
(45) Date of Patent: Feb. 11, 2025

(54) EXERCISE MAT AND METHODS FOR MAKING AN EXERCISE MAT

(71) Applicant: LULULEMON ATHLETICA CANADA INC., Vancouver (CA)

(72) Inventors: Colton Kai Yu, Vancouver (CA); Laura Julie Kelly, Vancouver (CA); Miguel Angel Herrera Macias, Vancouver (CA); Josh Nehru Samonte Delfin, Vancouver (CA); Kate Alexandria MacMillan, Vancouver (CA); Adrian Ka Ming Lai, Vancouver (CA); Jemon Lin, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 154 days.

(21) Appl. No.: 18/071,342

(22) Filed: Nov. 29, 2022

(65) Prior Publication Data

US 2023/0173333 A1 Jun. 8, 2023

Related U.S. Application Data

(60) Provisional application No. 63/285,949, filed on Dec. 3, 2021.

(51) Int. Cl.
*A63B 21/00* (2006.01)

(52) U.S. Cl.
CPC ..... *A63B 21/4037* (2015.10); *A63B 2209/00* (2013.01)

(58) Field of Classification Search
CPC .... A63B 21/4037; A63B 2209/00; A63B 6/00
See application file for complete search history.

(56) References Cited

U.S. PATENT DOCUMENTS

| | | | | |
|---|---|---|---|---|
| 9,463,348 | B2 * | 10/2016 | Connaughton | B32B 3/266 |
| 9,738,059 | B2 * | 8/2017 | Hing | B32B 37/12 |
| 2014/0259399 | A1 * | 9/2014 | Tsai | A63B 21/4037 5/420 |
| 2016/0030799 | A1 * | 2/2016 | Sutherland | A63B 21/4037 5/420 |
| 2017/0189742 | A1 * | 7/2017 | Mangum | A63B 21/4037 |
| 2021/0121733 | A1 | 4/2021 | Morris et al. | |
| 2021/0237393 | A1 * | 8/2021 | Hsieh | A63B 21/4037 |

* cited by examiner

*Primary Examiner* — Megan Anderson

(57) ABSTRACT

Examples of an exercise mat and methods for making same are disclosed. The exercise mat comprises a top layer, at least two textured gripping zones formed on an upper surface of the top layer and a bottom layer joined to the top layer. A second textured gripping zone of the at least two textured gripping zones may be formed closer to one or more mat edges of the exercise mat, and has a friction level that is greater than a friction level of a first textured gripping zone of the at least two textured gripping zones, when a body is in sliding contact with the at least two textured gripping zones of the upper surface of the top layer.

18 Claims, 3 Drawing Sheets

EXERCISE MAT AND METHODS FOR MAKING AN EXERCISE MAT

TECHNICAL FIELD

This application relates to the field of mats, and more specifically, to exercise mats and the like, and methods of making same.

BACKGROUND

Exercise mats, pads and cushions are often used during a variety of exercise activities that are conducted on a floor surface, such as yoga, Pilates and other training workouts. Many existing exercise mats are made of rubber, foam or other cushioning materials to provide comfort and cushioning to a user over hard flooring. For example, a user may position an exercise mat on a hard floor surface to provide a more comfortable experience during various yoga poses or stretching exercises.

Most exercise mats, such as yoga mats, are designed to be used at home without shoes. Such mats are not designed to be used with equipment (e.g. weights, shoes, etc.) or in different workouts where mats with abrasion resistant surfaces that support lateral training movements are required. These exercise mats may breakdown through use in more varied workouts with equipment. Furthermore, mats may slip or slide on a floor surface or the user may slip on the mat during lateral training movements.

Thus, there remains a need for exercise mats that are fully supportive to the user's body, and textured to support lateral movements and avoid slipping.

SUMMARY OF THE APPLICATION

In various embodiments, the present disclosure provides exercise mats incorporating areas of increased friction as compared to other areas of the exercise mat, the areas generally corresponding to sections of a top surface of the exercise mat where there is the most contact between the user and the exercise mat during use.

In one aspect, the present disclosure provides an exercise mat comprising: a top layer, at least two textured gripping zones formed on an upper surface of the top layer, the at least two textured gripping zones providing different levels of friction when a body is in sliding contact with the at least two textured gripping zones of the upper surface of the top layer, and a bottom layer joined to the top layer, wherein a friction level of a first textured gripping zone in sliding contact with the body is lower than a friction level of a second textured gripping zone in sliding contact with the body.

In various embodiments, the at least two textured gripping zones are joined by a seamless transition.

In various embodiments, the second textured gripping zone is positioned closer to one or more edges of the exercise mat.

In various embodiments, the exercise mat further comprises at least one additional textured gripping zone. For example, the at least one additional textured gripping zone may be positioned between the first and the second textured gripping zones. The at least one additional textured gripping zone may provide a friction level greater than the first textured gripping zone when in sliding contact with the body, and smaller than the second textured gripping zone when in sliding contact with the body. Alternatively, the friction level increases gradually from the first textured gripping zone toward the second textured gripping zone.

In various embodiments, the at least two textured gripping zones, including the at least one additional textured gripping zone, on the top layer of the exercise mat may comprise a plurality of raised surfaces extending upwards from the upper surface. For example, the textured gripping zones may comprise a plurality of semi-spheres, a height of the semi-spheres in the second textured gripping zone being greater than a height of the semi-spheres in the first textured gripping zone. Alternatively or in addition, a diameter of the semi-spheres in the second textured gripping zone may be greater than a diameter of the semi-spheres in the first textured gripping zone.

In various embodiments, the top layer comprises a polyvinyl butyral. For example, the top layer may comprise a polyvinyl butyral foam.

In various embodiments, the bottom layer comprises a polyvinyl butyral. For example, the bottom layer may comprise a polyvinyl butyral foam.

In various embodiments, a face surface of the bottom layer is at least partially textured, such as over the entire face surface, to provide friction between the face surface and a surface against which the mat is placed to prevent slippage of the exercise mat on the surface.

In various embodiments, the exercise mat further comprises a middle layer between the top layer and the bottom layer. For example, the middle layer may comprise a thermoplastic elastomer material.

In various embodiments, the top layer may also comprise at least one wicking agent, at least one antimicrobial agent, or both.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

In the following description, details are set forth to provide an understanding of the application. In some instances, certain structures, techniques, and methods have not been described or shown in detail in order not to obscure the application.

In the context of the present disclosure, various terms are used in accordance with what is understood to be the ordinary meaning of those terms.

Disclosed embodiments include exercise mats and methods of making same. In various embodiments, the disclosure provides exercise mats that may be used in a fitness studio environment or at a user's home, either inside or outside, where shoes, weights and/or other equipment are being used during exercise. In various embodiments, the exercise mat may be particularly suitable for high intensity and/or high impact work-outs involving lateral training movements. During such movements, users are more prone to slipping, in addition to the mat slipping on a floor surface. The exercise mats as described herein address these issues. The exercise mats as disclosed herein are for placement on a flat surface by a user to provide cushioning, grip, support, stability or any combination thereof, allowing the user to more easily and effectively perform yoga and/or other exercises, including high intensity training and other exercises involving lateral training movements.

Figure 1:
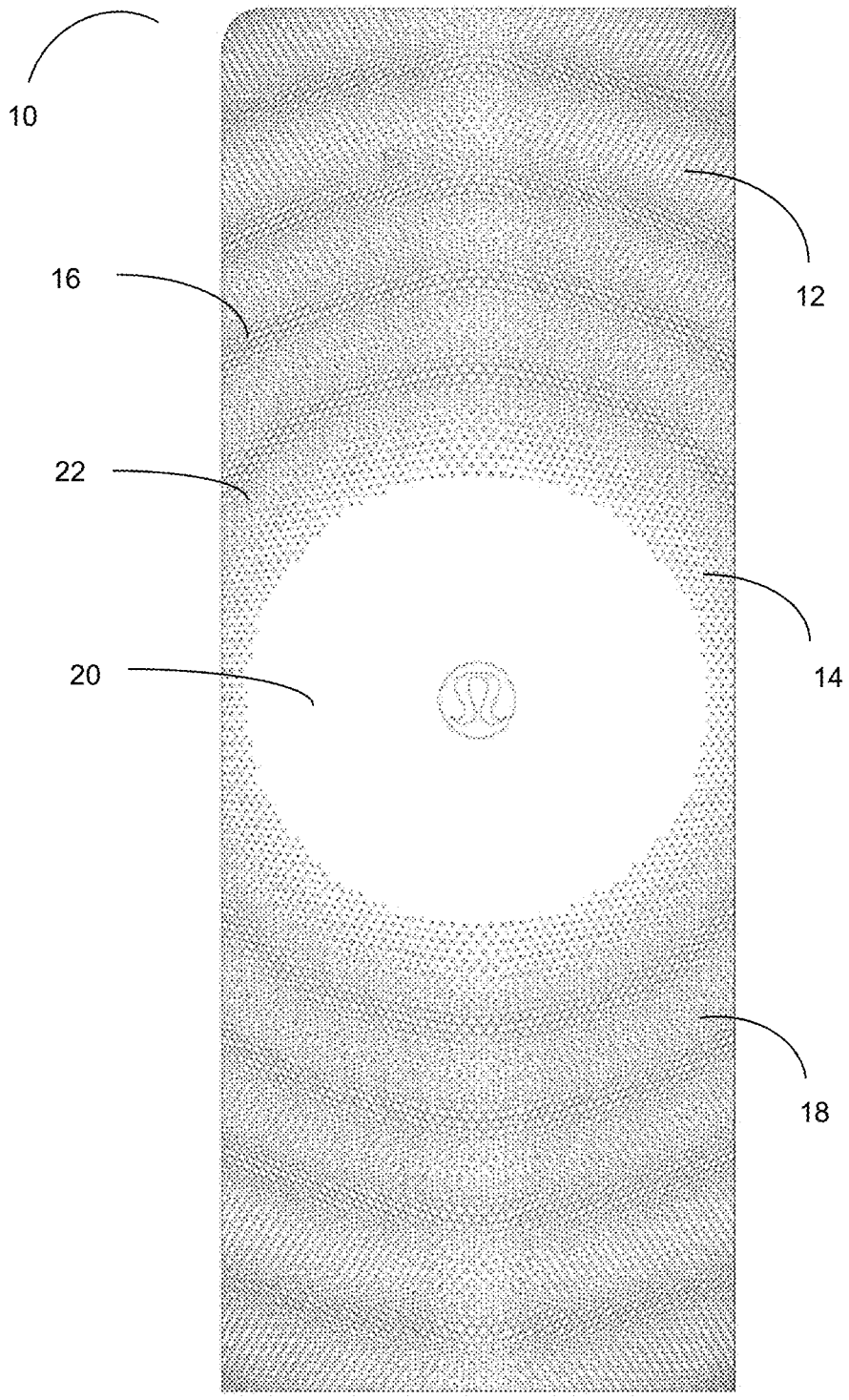
FIG. 1 is a plan view of an exercise mat in accordance with an embodiment of the invention.

Referring to FIG. 1 and according to a first embodiment of the invention, an exercise mat 10 is shown. The exercise mat 10 comprises a top layer 12. At least two textured gripping zones 14 and 16 are formed on an upper surface 18 of the top layer 12. The at least two textured gripping zones 14 and 16 provide different levels of friction when a body is in sliding contact with the at least two textured gripping zones 14 and 16 of the upper surface 18 of the top layer 12. In various embodiments, a friction level of a first textured gripping zone 14 in sliding contact with the body is lower than a friction level of a second textured gripping zone 16 in sliding contact with the body. This textured grip supports lateral training movements and provides increased traction to the user. In various embodiments, the term "body" refers to any entity that may be in sliding contact with the at least two textured gripping zones 14 and 16 of the upper surface 18 of the top layer 12, and includes a user of the exercise mat 10 who may touch the exercise mat with any body part, such as hands, feet (with or without shoes) or torso, or any exercise equipment such as weights. The exercise mat 10 further comprises a bottom layer (not shown) joined to the top layer 12. The bottom layer provides further cushioning to the user while the exercise mat 10 is in use.

Although a rectangular exercise mat is shown in FIG. 1, the exercise mat 10 may have other shapes, such as square, circle or oval, or any other shape or design.

In various embodiments, the exercise mat 10 may also comprise one or more areas of no texture 20, as shown in FIG. 1.

In various embodiments, the second textured gripping zone 16 is positioned closer to one or more edges of the exercise mat 10 as shown in FIG. 1, where the upper surface 18 of the top layer 12 has one or more textured gripping zones that have a higher friction level as compared to the first textured gripping zone 14, and is closer to all four edges of the exercise mat 10. The at least two textured gripping zones 14 and 16 may be positioned such that the friction level against the body in sliding contact with the at least two textured gripping zones 14 and 16 increases toward one or both of the vertical edges and/or toward one or both of the horizontal edges of the exercise mat 10.

In various embodiments, the exercise mat 10 further comprises at least one additional textured gripping zone 22. The at least one additional textured gripping zone 22 may be positioned between the first 14 and second 16 textured gripping zones. In such embodiments, the at least one additional textured gripping zone 22 provides a friction level greater than the first textured gripping zone 14 when in sliding contact with the body and smaller than the second textured gripping zone 16 when in sliding contact with the body. In some embodiments, the at least one additional textured gripping zone 22 may alternate with the second textured gripping zone 16 in any pattern. For example, the at least one additional textured gripping zone 22 may alternate concentrically with the second textured gripping zone 16, as shown in FIG. 1 or they may alternative in horizontal or vertical lines. Each of the alternating textured gripping zones may be slightly different such that the friction level against the body in sliding contact with the top surface 18 of the top layer 12 of the exercise mat 10 increases towards one or more edges of the exercise or towards a perimeter of the exercise mat.

Figure 2:
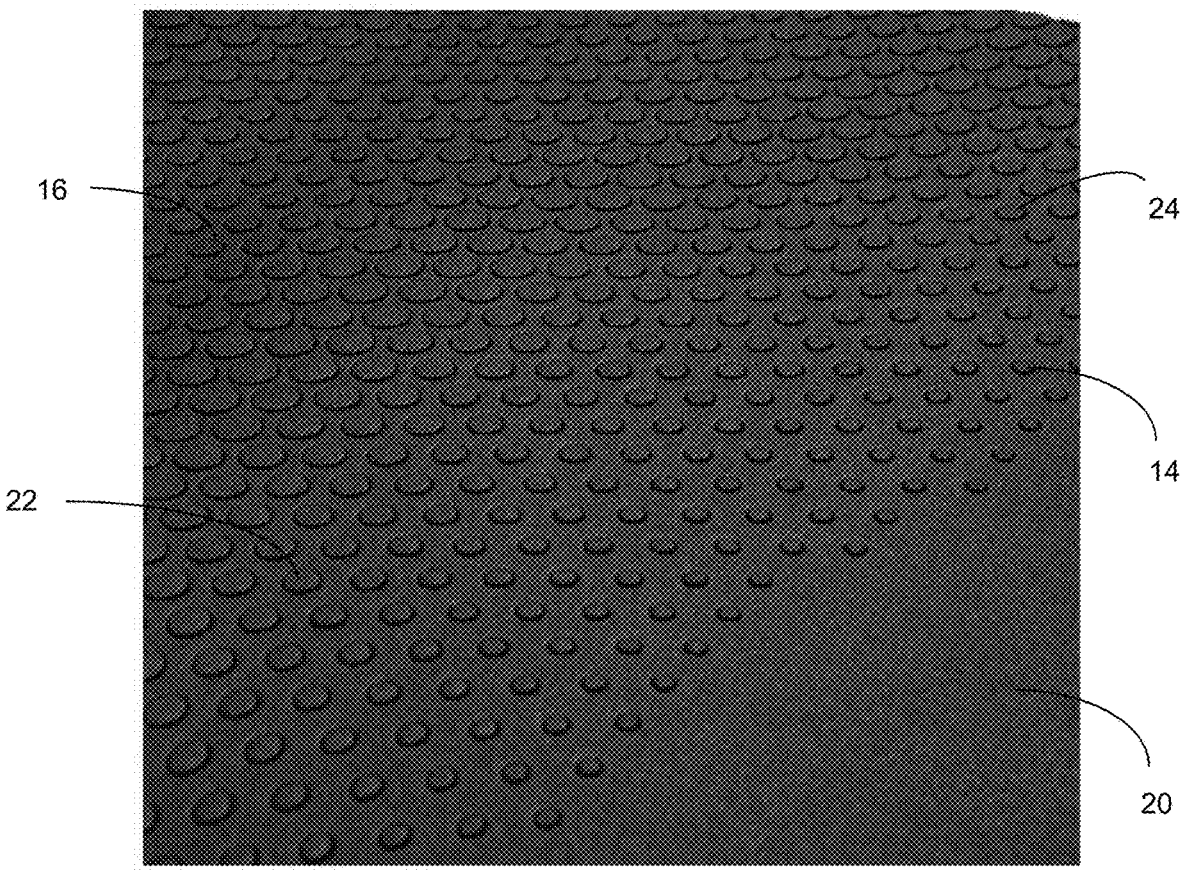
FIG. 2 is a photograph of the transition of the at least two textured gripping zones from the first textured gripping zone 14, to the at least one additional textured gripping zone 22 and then to the second textured gripping zone 16. The at least two textured gripping zones comprise a plurality of semi-spheres having a similar height and varying dimeter.

As shown in FIG. 2, a friction level may increase gradually from the first textured gripping zone 14 toward the second textured gripping zone 16, through the at least one additional texture gripping zone 22. Alternatively, the at least two textured gripping zones 14 and 16 may be joined by a seamless transition.

The at least two textured gripping zones 14 and 16, as well as the at least one additional textured gripping zone 22, may comprise a plurality of semi-spheres 24, as shown in FIG. 2. A height of each of the plurality of semi-spheres 24 in the second textured gripping zone may be greater than a height of each of the plurality of semi-spheres 24 in the first textured gripping zone. In various embodiments, the height of each of the plurality of semi-spheres 24 in the at least two textured gripping zones 14 and 16 may be approximately the same. Alternatively or in addition, a diameter of each semi-sphere in the plurality of semi-spheres 24 in the second textured gripping zone 16 may be greater than a diameter of each semi-sphere in the plurality of semi-spheres 24 in the first textured gripping zone 14 (as shown in FIG. 2), and/or a density of the plurality of semi-spheres 24 in the second textured gripping zone 16 may be greater than a density of the plurality of semi-spheres 24 in the first textured gripping zone 14.

In various embodiments, the top layer 12 and/or the bottom layer may comprise a polyvinyl butyral, which may be recycled and/or used polyvinyl butyral. By being made of polyvinyl butyral, the exercise mats as disclosed herein may have higher abrasion resistance as compared to other mats. For example, the top layer 12 and/or the bottom layer comprise a polyvinyl butyral foam, such as a closed cell polyvinyl butyral foam, making the mat easier to clean and/or more stain resistant as compared to previous mats.

In various embodiments, a face surface of the bottom layer of the exercise mat may be at least partially textured to provide increased friction between the face of the bottom layer of the exercise mat and a surface against which the exercise mat is placed to decrease or prevent slippage of the exercise mat on the surface during use.

In various embodiments, the exercise mats as disclosed herein further comprise a middle layer between the top layer 12 and the bottom layer. For example, the middle layer may comprise a thermoplastic elastomer material. For such embodiments, the exercise mat 10 may be prepared by joining the top layer 12 and the middle layer, and then the at least two textured gripping zones are embossed on the top surface 18 of the top layer 12 as described in further detail below.

In various embodiments, a thickness of the exercise mats as disclosed herein may be between about 0.5 mm and about 6.5 mm, between about 0.5 mm and about 4.5 mm, between about 0.5 mm and about 3.5 mm, or any thickness therebetween. In various embodiments, the exercise mat has a thickness of about 6.5 mm.

In various embodiments, the exercise mats as disclosed herein may weight about 3.5 lbs.

In various embodiments, the exercise mats as disclosed herein have sufficient flexibility such that they can be rolled and/or folded for transport and/or storage.

The exercise mats as disclosed herein may be prepared by mixing a combination of ingredients, such as, for example, polyvinyl butyral, triglycol dioctate, stearic acid and water, as well as other optional additives such as foaming agents, fillers, plasticizing agents and the like. The materials may be mixed, melted and blended in an extruding machine or mixing machine. The exercise mats may then be formed through compression molding, using a mold comprising the at least two textured gripping zones for the top layer 12, and a separate mold for the bottom layer. In various embodiments, the top layer 12 may further be treated with an antimicrobial agent, such as, for example, a silver-based antimicrobial agent and/or 3-trimethoxy propyl dimethyl octadecyl ammonium chloride.

The top layer 12 and the bottom layer are then joined, with an optional middle layer therebetween. For example, the layers may be joined using an adhesive or a bonding technique. In various embodiments, the layers may have thermoplastic bonding properties that cause adjacent layers to bond with one another when heated. Alternatively, the layers may be bonded using adhesives and/or mechanical connections. In addition, any combination of these methods or any other methods known to those of ordinary skill in the art may be used.

In various embodiments, the exercise mat 10 may be made using a vacuum embossing machine. The vacuum embossing machine may include a mold plate having an embossed top surface that has a female version of the textured gripping zones embossed thereon to form a male version of the textured gripping zones on the exercise mat 10. The top layer 12 of the exercise mat 10 is attached to the middle layer, the middle layer comprising a thermoplastic elastomer material. The mat formed from joining the top and middle layers is cut to a desired size and shape, and is positioned on the mold plate having the embossed top surface, with the polyvinyl butyral side of the top layer facing the embossed top surface texture of the mold plate. The mold plate is inserted into a vacuum embossing machine and the mat is heated, for example, for about two minutes at a temperature of about 170° C., or alternatively, for about 1 to about 15 minutes at a temperature of about 120° C. to about 200° C., and with a suction pressure provided by the embossing machine such that the temperature and suction provided by the vacuum embossing machine softens the thermoplastic elastomer of the middle layer and conforms it to the textured gripping zones of the mold plate to form a corresponding surface texture through the polyvinyl butyral side of the top layer 12. The mat can then be cooled, and the bottom layer is attached to form the exercise mat 10.

Following production, the exercise mats as disclosed herein may comprise about 70% or more polyvinyl butyral, about 25% or more triglycol dioctate, about 3.5% or less stearic acid, and about 1.5% or less water.

EXAMPLES

These examples illustrate various aspects of the invention, evidencing different embodiments of the exercise mats as disclosed herein. Selected examples are illustrative of advantages that may be obtained compared to alternative exercise mats, and these advantages are accordingly illustrative of particular embodiments and not necessarily indicative of the characteristics of all aspects of the invention.

Figure 3:
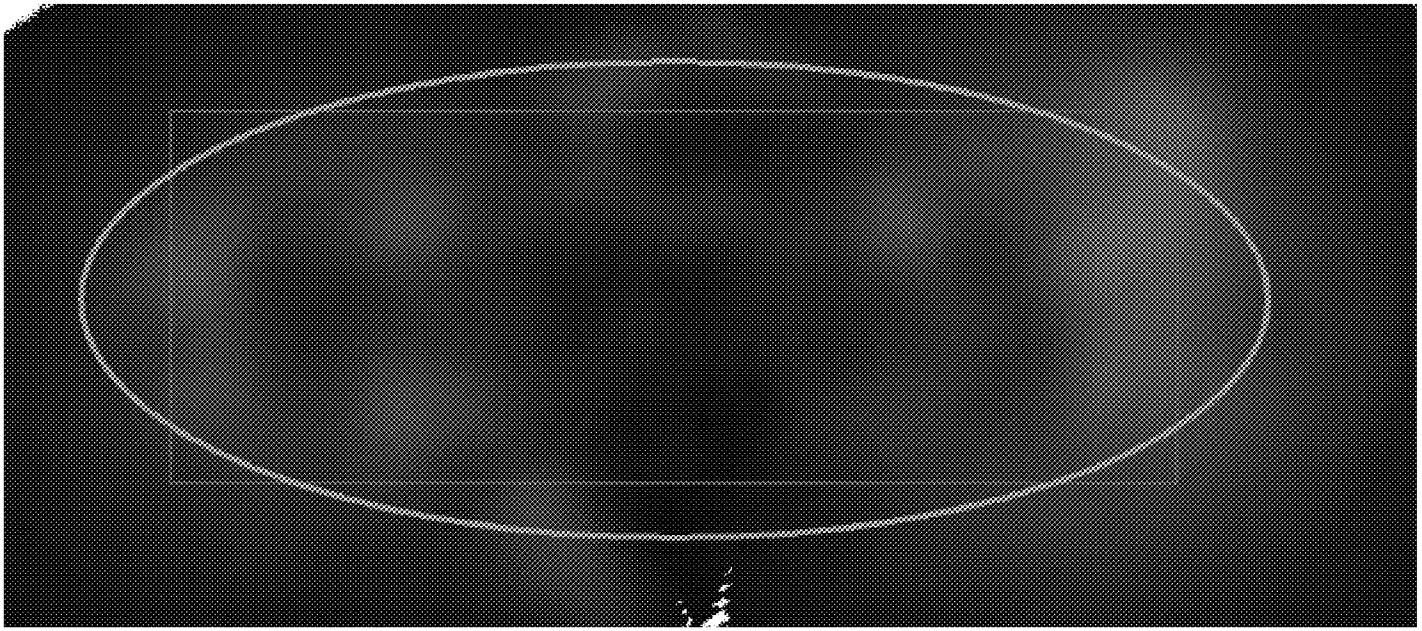
FIG. 3 is a heatmap of contact points between a user of an exercise mat and the exercise mat during high-intensity interval training.

Example 1: Location on Exercise Mat Requiring Increased Friction Between a User and the Exercise Mat In order to determine the locations on an exercise mat where a body requires increased friction, a heat map was generated while a user of the exercise mat engaged in high-intensity interval training. As shown in FIG. 3, it was found that the user made contact with the exercise mat closer to one or more edges of the exercise mat. As a result, the second textured gripping zone 16 was position around a perimeter of the exercise mat 10, to generate higher friction levels between the user and the exercise mat 10 when the user is in sliding contact with the second textured gripping zone 16 on the upper surface 18 of the top layer 12.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. An exercise mat comprising:

a top layer;

at least two textured gripping zones formed on an upper surface of the top layer, wherein the at least two textured gripping zones comprise a first textured gripping zone and a second textured gripping zone, the at least two textured gripping zones configured to provide different levels of friction when a body is in sliding contact with the at least two textured gripping zones of the upper surface of the top layer; and a bottom layer joined to the top layer, wherein a friction level of the first textured gripping zone in sliding contact with the body is lower than a friction level of the second textured gripping zone in sliding contact with the body, and wherein a friction level increases gradually from the first textured gripping zone toward the second textured gripping zone.

2. The exercise mat of claim 1, wherein the at least two textured gripping zones further comprise at least one additional textured gripping zone.

3. The exercise mat of claim 2, wherein the least one additional textured gripping zone is positioned between the first and the second textured gripping zones.

4. The exercise mat of claim 3, wherein the least one additional textured gripping zone provides a friction level greater than the first textured gripping zone when in sliding contact with the body and smaller than the second textured gripping zone when in sliding contact with the body.

5. The exercise mat of claim 1, wherein the top layer comprises a polyvinyl butyral.

6. The exercise mat of claim 5, wherein the top layer comprises a polyvinyl butyral foam.

7. The exercise mat of claim 6, wherein the top layer comprises a closed cell polyvinyl butyral foam.

8. The exercise mat of claim 1, wherein the at least two textured gripping zones on the top layer comprise a plurality of raised surfaces extending upwards from the upper surface.

9. The exercise mat of claim 8, wherein the plurality of raised surfaces comprise a plurality of semi-spheres, a height of the plurality of semi-spheres in the second textured gripping zone is greater than a height of the plurality of semi-spheres in the first textured gripping zone.

10. The exercise mat of claim 9, wherein a diameter of the plurality of semi-spheres in the second textured gripping zone is greater than a diameter of the plurality of semi-spheres in the first textured gripping zone.

11. The exercise mat of claim 1, wherein the bottom layer comprises a polyvinyl butyral.

12. The exercise mat of claim 11, wherein the bottom layer comprises a polyvinyl butyral foam.

13. The exercise mat of claim 1, further comprising a middle layer between the top layer and the bottom layer.

14. The exercise mat of claim 13, wherein the middle layer comprises a thermoplastic elastomer material.

15. The exercise mat of claim 1, wherein the second textured gripping zone is positioned closer to one or more edges of the exercise mat.

16. The exercise mat of claim 1, wherein the at least two textured gripping zones are joined by a seamless transition.

17. The exercise mat of claim 1, wherein a face surface of the bottom layer is at least partially textured to provide friction between the face surface and a surface against which the exercise mat is placed to prevent slippage of the exercise mat on the surface.

18. The exercise mat of claim 1, wherein the top layer comprises at least one wicking agent, at least one antimicrobial agent or both.

* * * * *